US008127726B2

(12) United States Patent
Kim et al.

(10) Patent No.: US 8,127,726 B2
(45) Date of Patent: Mar. 6, 2012

(54) VARIABLE VALVE LIFT APPARATUS

(75) Inventors: Back Sik Kim, Osan (KR); Ingee Suh, Yongin (KR); Dong Hee Han, Seoul (KR); Woo Tae Kim, Suwon (KR); Hyung Ick Kim, Gunpo (KR); Dae Sung Kim, Hwaseong (KR); Kyoung Pyo Ha, Suwon (KR)

(73) Assignees: Hyundai Motor Comapny, Seoul (KR); Kia Motors Corporation, Seoul (KR)

( * ) Notice: Subject to any disclaimer, the term of this patent is extended or adjusted under 35 U.S.C. 154(b) by 832 days.

(21) Appl. No.: 12/238,112

(22) Filed: Sep. 25, 2008

(65) Prior Publication Data

US 2009/0151676 A1 Jun. 18, 2009

(30) Foreign Application Priority Data

Dec. 14, 2007 (KR) ..... 10-2007-0131573

(51) Int. Cl.
*F01L 1/34* (2006.01)
*F01L 1/18* (2006.01)

(52) U.S. Cl. ..... 123/90.16; 123/90.15; 123/90.44; 123/90.17

(58) Field of Classification Search ..... 123/90.15, 123/90.16, 90.17, 90.44
See application file for complete search history.

(56) References Cited

U.S. PATENT DOCUMENTS 7,201,125 B2 4/2007 Evans et al.

FOREIGN PATENT DOCUMENTS

KR 10-2007-0113560 A 11/2007

*Primary Examiner* — Thomas Denion
*Assistant Examiner* — Michael Carton
(74) *Attorney, Agent, or Firm* — Morgan, Lewis & Bockius LLP

(57) ABSTRACT

A variable valve lift apparatus includes a camshaft with a first cam lobe and a second cam lobe, a cam follower with a first follower contacting the first cam lobe and a second follower contacting the second cam lobe, a connection rotatably connecting the first follower to the second follower, a main body supporting the first follower and the second follower, a connector selectively connecting the first follower and the second follower to the main body, a lost motion elastic member provided on the main body for supplying restoring force to the first follower and the second follower, and a valve configured to be opened and closed by the cam follower.

12 Claims, 6 Drawing Sheets

VARIABLE VALVE LIFT APPARATUS

CROSS-REFERENCE TO RELATED APPLICATION

This application claims priority to, and the benefit of, Korean Patent Application No. 10-2007-0131573, filed in the Korean Intellectual Property Office on Dec. 14, 2007, the entire contents of which are incorporated herein by reference.

BACKGROUND OF THE INVENTION (a) Field of the Invention

The present invention relates to a variable valve lift apparatus with a low lift mode, a high lift mode, and a CDA mode.

(b) Description of the Related Art

A typical combustion chamber of an automotive engine is provided with an intake valve, for supplying an air/fuel mixture, and an exhaust valve, for expelling burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of gas that is introduced or exhausted. However, valve timing and amount of lift should ideally be optimized for different driving speeds.

The above information disclosed in this Background section is only for enhancement of understanding of the background of the invention and therefore it may contain information that does not form the prior art that is already known in this country to a person of ordinary skill in the art.

SUMMARY OF THE INVENTION

A variable valve lift apparatus includes a camshaft with a first cam lobe and a second cam lobe, a cam follower with a first follower contacting the first cam lobe and a second follower contacting the second cam lobe, a connection rotatably connecting the first follower to the second follower, a main body supporting the first follower and the second follower, a connector selectively connecting the first follower and the second follower to the main body, a lost motion elastic member provided on the main body for supplying restoring force to the first follower and the second follower, and a valve configured to be opened and closed by the cam follower.

The connector may include several locker pins. The apparatus may further include a hydraulic pressure supplying apparatus that selectively supplies hydraulic pressure to the locker pins for the first follower or the second follower to be connected to the main body. The locker pins may include a first locker pin, a second locker pin, and a return pin that supplies a restoring force to the first locker pin. The hydraulic pressure supplying apparatus may include a first hydraulic pressure supplying apparatus that supplies hydraulic pressure to the first locker pin, and a second hydraulic pressure supplying apparatus that supplies hydraulic pressure to the second locker pin. Each hydraulic pressure supplying apparatus may include a hydraulic piston and a blocking plate.

When the first locker pin is supplied hydraulic pressure from the first hydraulic pressure supplying apparatus, it may disconnect the first follower from the main body. When the second locker pin is supplied hydraulic pressure from the second hydraulic pressure supplying apparatus, it may connect the second follower to the main body.

The apparatus may further include a first supporting pin on the main body, a first supporting pin hole in the return pin for preventing interference with the supporting pin, and a first return spring between the supporting pin and the return pin for supplying restoring force to the return pin.

The apparatus may further include a second supporting pin in the second follower, a second supporting pin hole in the second locker pin for preventing interference with the second supporting pin, and a second return spring disposed between the second supporting pin and the second locker pin for supplying restoring force to the second locker pin.

The apparatus may further include a stopper between the second supporting pin and the second locker pin.

The cam follower may include a first roller contacting the first cam lobe and a second roller contacting the second cam lobe. The first follower may include a supporting step for preventing the first follower from disconnecting from the main body.

The lost motion elastic member may include a spring cap, a plunger, and a lost motion spring between the spring cap and the plunger.

The connection may include a connecting pin and a connecting pin insertion hole.

Figure 1:
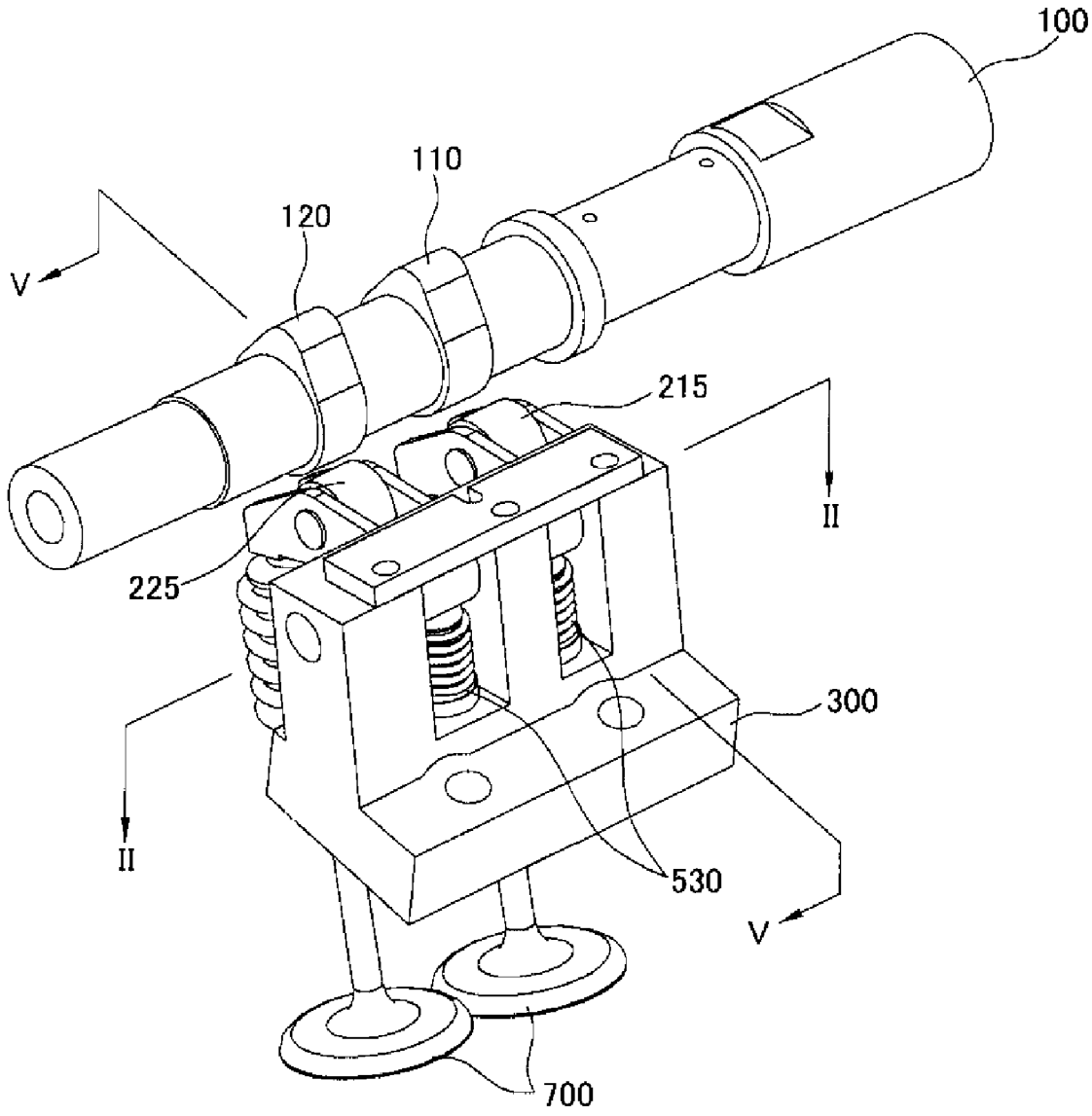
FIG. 1 is a perspective view of a variable valve lift apparatus according to an exemplary embodiment.

FIG, 4 is an exploded perspective view of a connector of the apparatus of FIG. 1.

Figure 5:
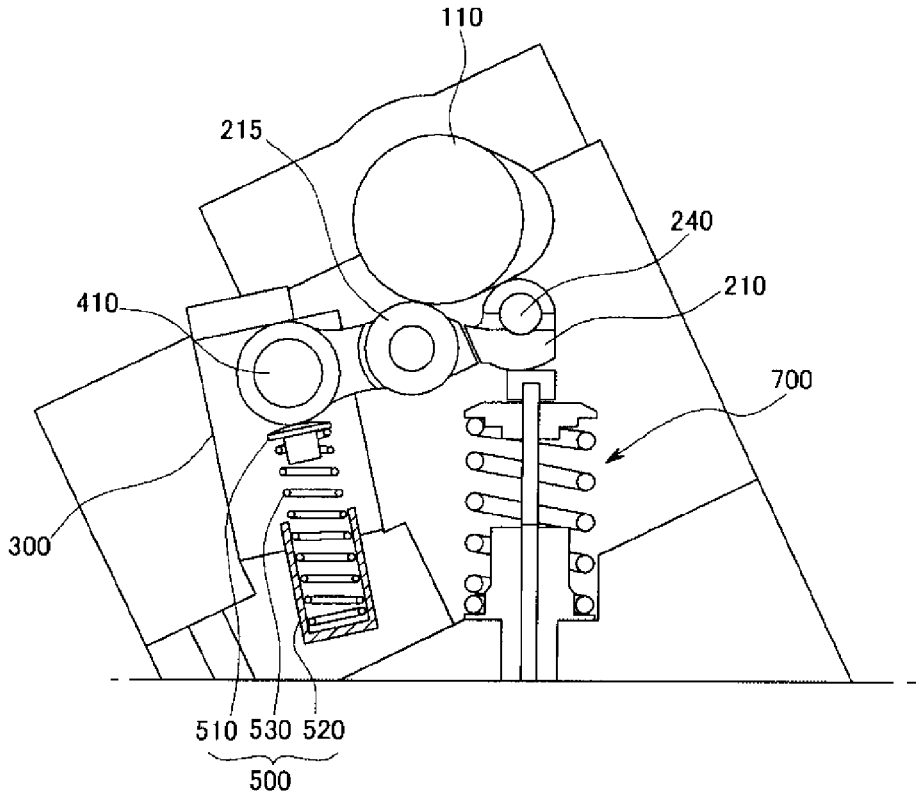

FIG. 5 is a cross-sectional view taken along line V-V of FIG. 1.

Figure 6:
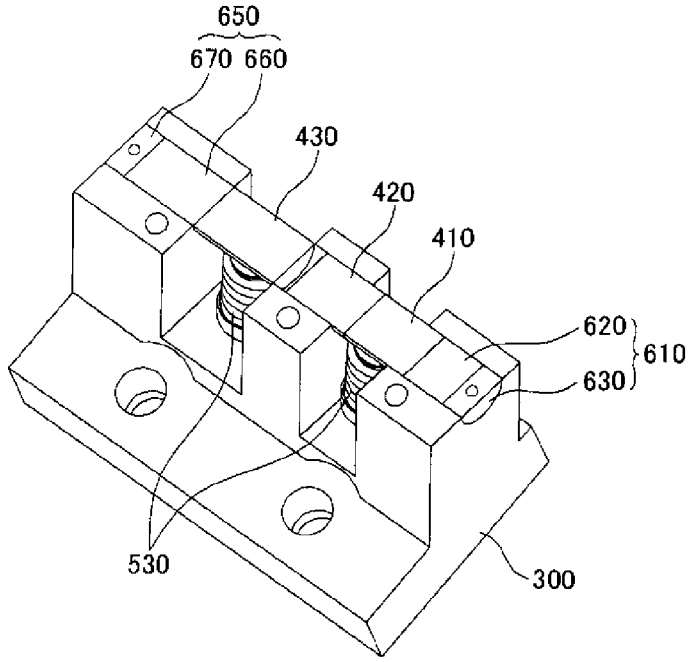

FIG. 6 is a perspective view of a connector of the apparatus of FIG. 1 in a low lift mode.

Figure 7:
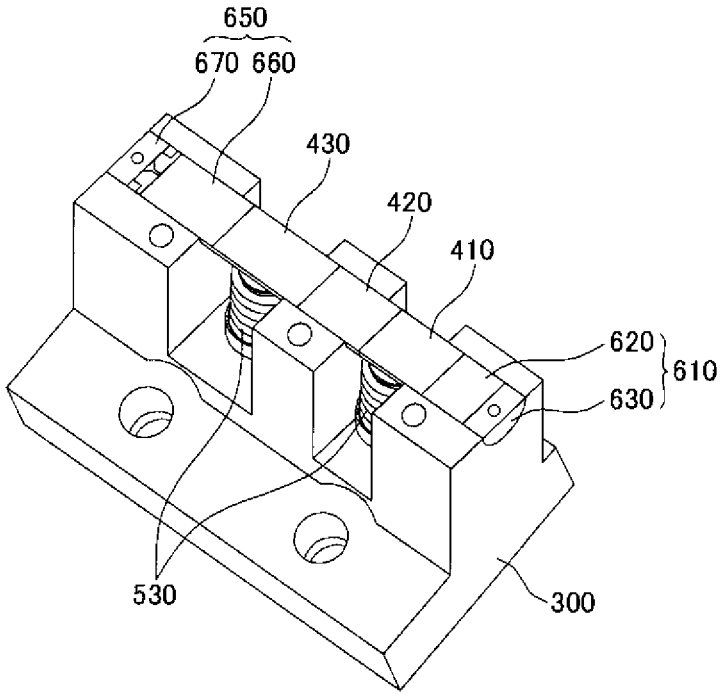

FIG. 7 is a perspective view of the connector of FIG. 6 in a high lift mode.

Figure 8:
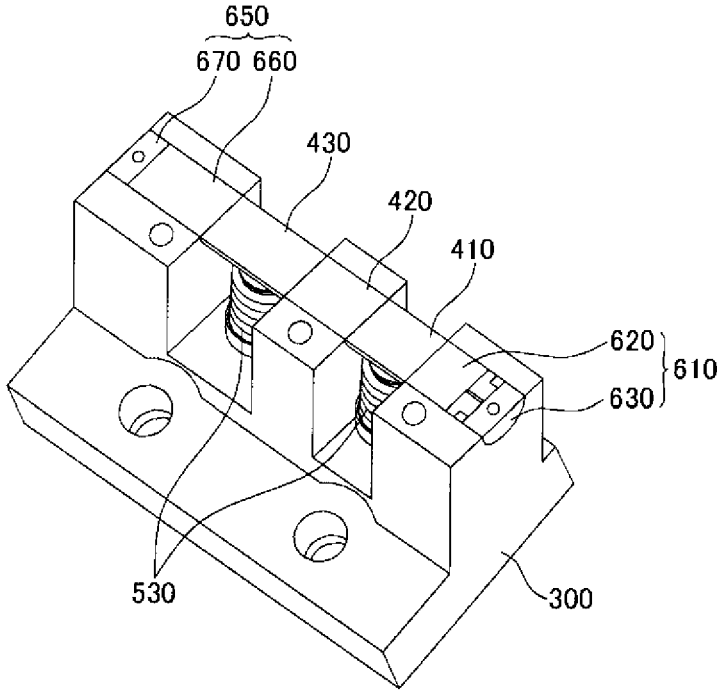

FIG. 8 is a view of the connector of FIG. 6 in a CDA lift mode.

DETAILED DESCRIPTION OF PREFERRED EMBODIMENTS

An exemplary embodiment of the present invention will hereinafter be described in detail with reference to the accompanying drawings.

Referring to FIG. 1 to FIG. 5, a variable valve lift apparatus according to an exemplary embodiment of the present invention includes a camshaft 100 including a first cam lobe 110 and a second cam lobe 120.

Figure 2:
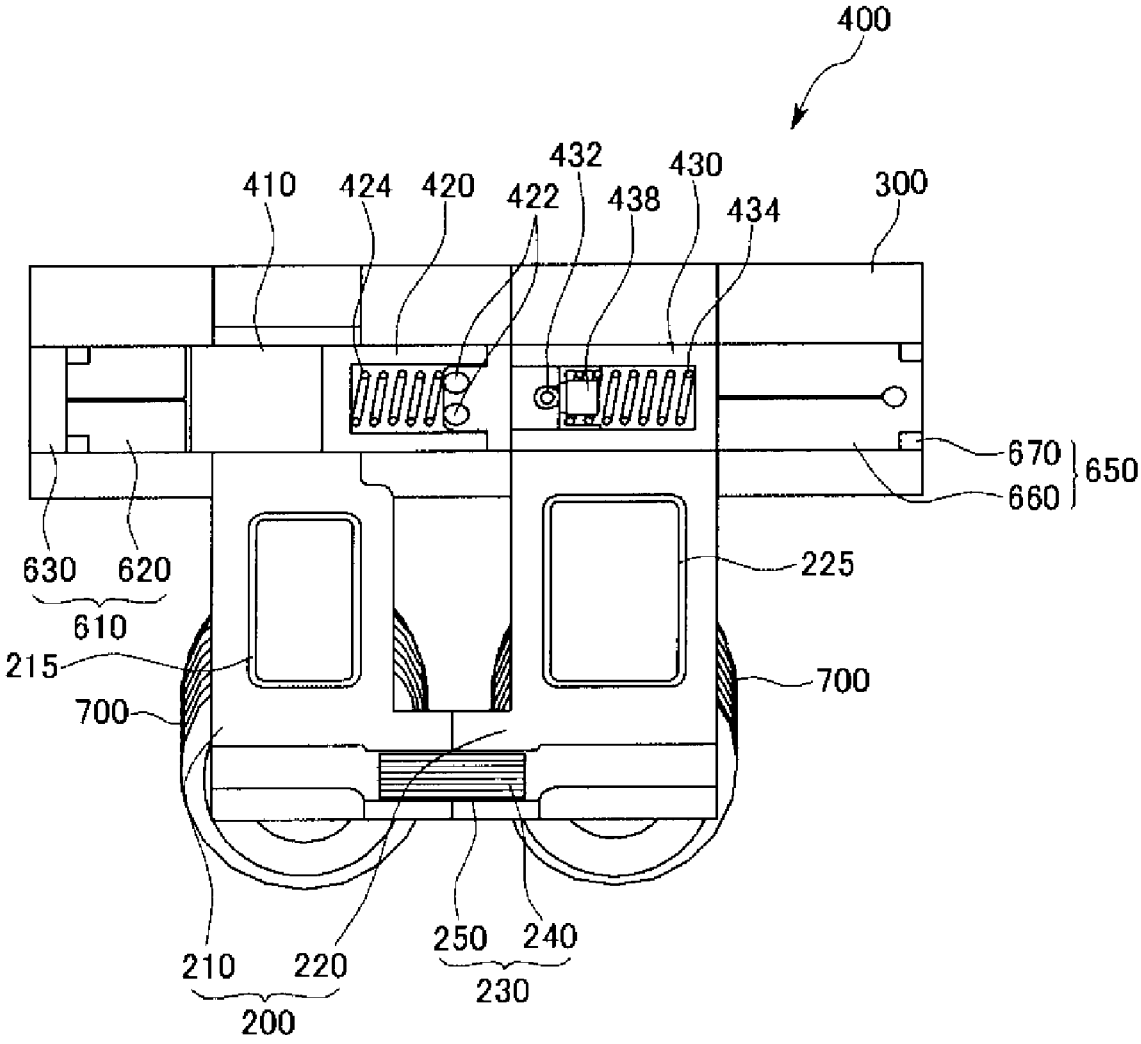
FIG. 2 is a cross-sectional view taken along line II-II of FIG. 1.

Referring to FIG. 2, a cam follower 200 includes a first follower 210 and a second follower 220. The first follower 210 contacts the first cam lobe 110 and the second follower 220 contacts the second cam lobe 120.

A first roller 215 contacting the first cam lobe 110 is disposed on the first follower 210, and a second roller 225 contacting the second cam lobe 120 is disposed on the second follower 220.

The followers 210, 220 are rotatably connected by a connection 230, which includes a connecting pin insertion hole 250 and a connecting pin 240 disposed within the connecting pin insertion hole 250.

The first follower 210 and the second follower 220 are supported by a main body 300.

A connector 400 selectively connects the followers 210, 220 to the main body 300.

A lost motion elastic member 500 (FIG. 5) is disposed in the main body 300 for supplying restoring force to the first follower 210 and the second follower 220.

A valve 700 is selectively opened and closed by the cam follower 200.

The connector 400 includes a first locker pin 410, a second locker pin 430, and a return pin 420 that supplies restoring force to the first locker pin 410.

A hydraulic pressure supplying apparatus supplies hydraulic pressure to the locker pins 410, 430 so that the first follower 210 or the second follower 220 may be selectively connected with the main body 300.

The hydraulic pressure supplying apparatus includes a first hydraulic pressure supplying apparatus 610 supplying hydraulic pressure to the first locker pin 410, and a second hydraulic pressure supplying apparatus 650 supplying hydraulic pressure to the second locker pin 430.

The first hydraulic pressure supplying apparatus 610 includes a first hydraulic piston 620 and a first blocking plate 630, and the second hydraulic pressure supplying apparatus 650 includes a second hydraulic piston 660 and a second blocking plate 670.

The first locker pin 410 selectively receives hydraulic pressure from the first hydraulic pressure supplying apparatus 610 for disconnecting the first follower 210 from the main body 300. That is, when hydraulic pressure is not supplied to the first locker pin 410, it is disposed in both the first follower 210 and the main body 300, connecting the first follower 210 and the main body 300 (see FIGS. 2 and 7). When hydraulic pressure is supplied to the first locker pin 410, it is disposed in only the first follower 210, disconnecting it from the main body 300 (see FIG. 8).

The second locker pin 430 selectively receives hydraulic pressure from the second hydraulic pressure supplying apparatus 650 for connecting the second follower 220 to the main body 300. That is, when hydraulic pressure is not supplied to the second locker pin 430, it is disposed in only the second follower 220, disconnecting it from the main body 300 (see FIGS. 2 and 8). When hydraulic pressure is supplied to the second locker pin 430, it is disposed in both the second follower 220 and the main body 300, connecting the second follower 220 and the main body 300 (see FIG. 7).

Referring to FIG. 2, a first supporting pin 422 is provided at the main body 300, and a first return spring 424 is disposed between the first supporting pin 422 and the return pin 420 and supplies restoring force to the return pin 420.

A first supporting pin hole 426 is formed in the return pin 420 to prevent interference of the return pin 420 and the first supporting pin 422 when the return pin 420 moves.

A second supporting pin 432 is inserted into the second follower 220, and a second supporting pin hole 436 is formed to the second locker pin 430 for preventing interference of the second supporting pin 432.

A second return spring 434 is disposed between the second supporting pin 432 and the second locker pin 430 for supplying restoring force to the second locker pin 430.

A stopper 438 is disposed between the second supporting pin 432 and the locker pin 430 for preventing the second supporting pin 432 from moving more than a certain distance.

Figure 3:
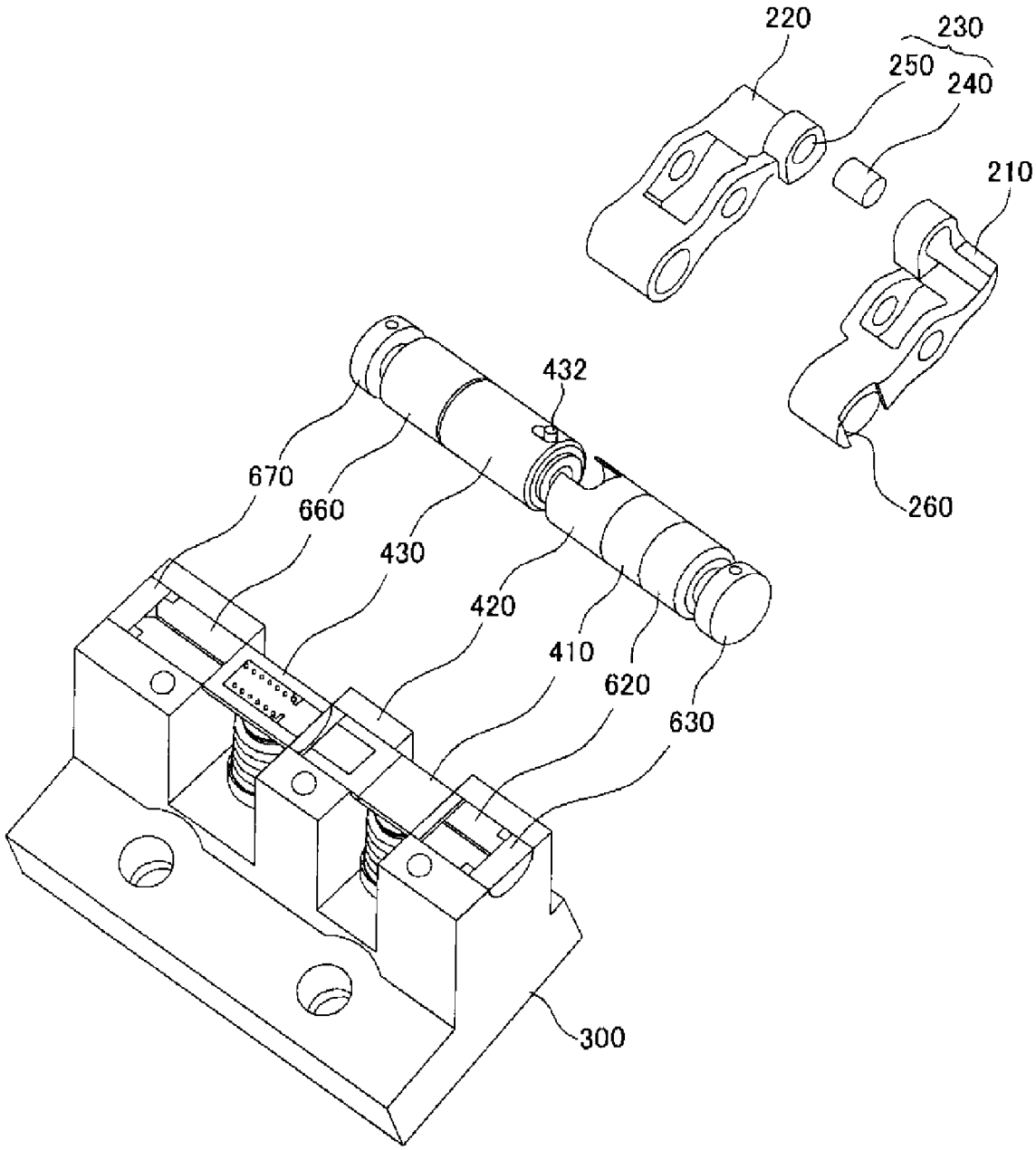
FIG. 3 is a partial exploded perspective view of the apparatus of FIG. 1.
Figure 4:
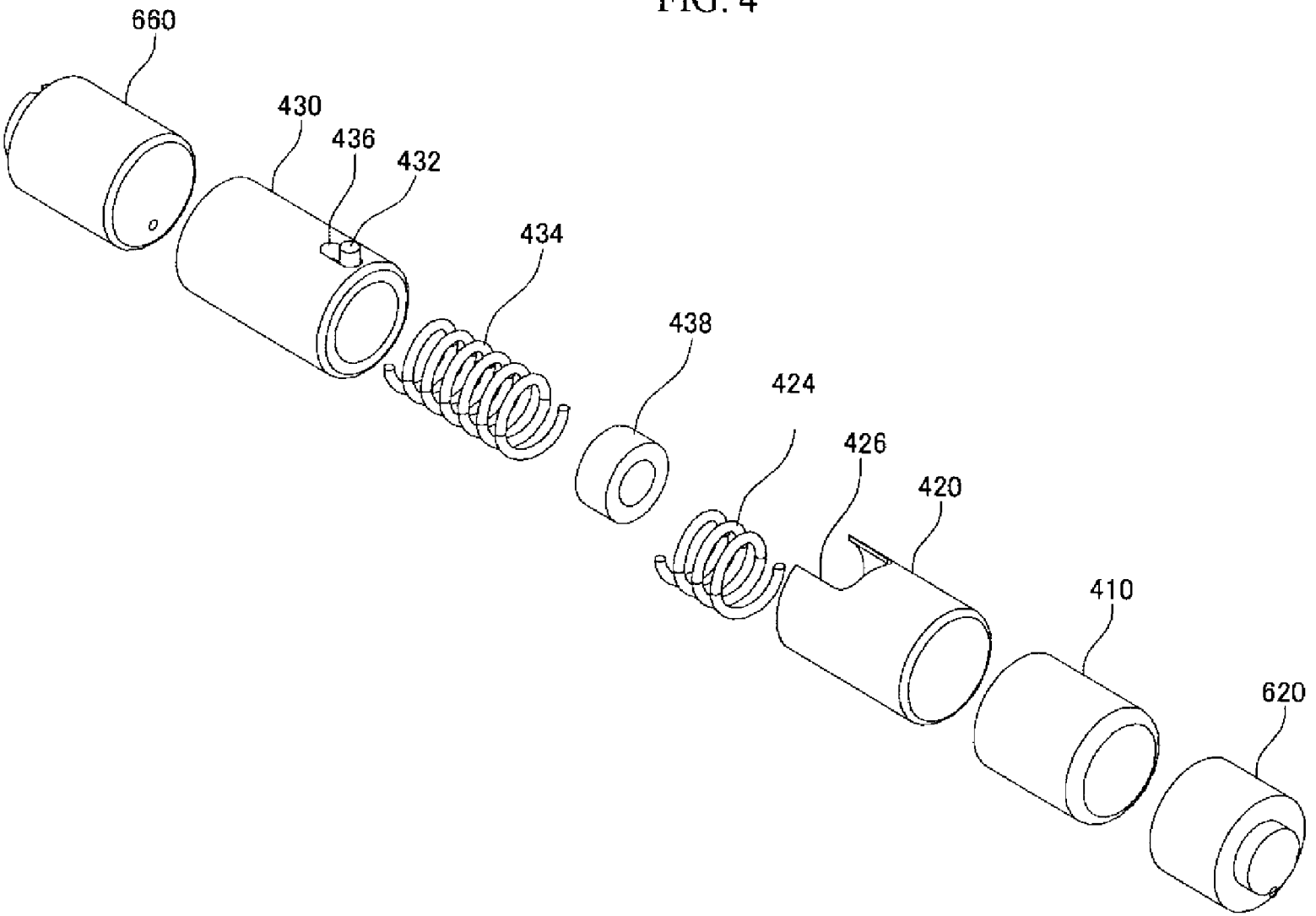

As shown in FIG. 3, a supporting step 260 is provided on the first follower 210 for preventing the first follower 210 from separating from the main body 300.

Referring to FIG. 5, the lost motion elastic member 500 includes a spring cap 510, a plunger 520, and a lost motion spring 530 disposed between the spring cap 510 and the plunger 520.

Referring to FIG. 2 and FIG. 5, when the first locker pin 410 connects the main body 300 with the first follower 210, the first cam lobe 110 pushes the first roller 215 and then the follower 210 pivotally rotates with respect to the first locker pin 410, and opens and closes the valve 700.

When the first locker pin 410 is inserted within the first follower 210, a lost motion of the follower 2 10 occurs and the valve 700 is not opened or closed even if the first cam lobe 10 pushes the first roller 215.

An operation of the second follower 220 is similar to that of the first follower 210 so a detailed explanation thereof will be omitted.

Now, for ease of description, the first cam lobe 110 will be considered a low lift cam lobe, and the second cam lobe 120 will be considered a high lift cam lobe.

Referring to FIG. 2 and FIG. 6, a low lift mode of the variable valve lift apparatus according to an exemplary embodiment of the present invention will be explained.

In the low lift mode, hydraulic pressure is not supplied. As shown in FIG. 6, the second locker pin 430 is disposed within the second follower 220, and the first locker pin 410 connects the main body 300 with the first follower 210.

Even if the second cam lobe 120 rotates, the second follower 220 has lost motion and the valve 700 is opened and closed by the rotation of the first cam 110 lobe through the first follower 210.

Referring to FIG. 2 and FIG. 7, a high lift mode of the variable valve lift apparatus according to an exemplary embodiment of the present invention will be explained.

In the high lift mode, hydraulic pressure is supplied to the second locker pin 430 through the second hydraulic pressure supplying apparatus 650.

As shown in FIG. 7, the second locker pin 430 connects the second follower 220 with the main body 300, and the first locker pin 410 connects the main body 300 with the first follower 210.

Rotation of both the first cam lobe 110 and the second cam lobe 120 are transmitted to the first follower 210 and the second follower 220, respectively, but the valve 700 is opened by the second cam lobe 220 as a high lift cam lobe.

Referring to FIG. 2 and FIG. 8, a CDA mode of the variable valve lift apparatus according to an exemplary embodiment of the present invention will be explained.

In the CDA mode, hydraulic pressure is supplied to the first locker pin 410 through the first hydraulic pressure supplying apparatus 610.

As shown in FIG. 8, the first locker pin 410 and the second locker pin 430 are disposed within the first follower 210 and the second follower 220, respectively, so that the first follower 210 and the second follower 220 are disconnected from the main body 300.

Thus, both the first follower 210 and the second follower 220 have lost motion so that the valve 700 is not opened and closed.

The operation of the first hydraulic pressure supplying apparatus 610 and the second hydraulic pressure supplying apparatus 650 may be controlled by an engine control unit (ECU, not shown), which determines operation conditions of the engine through sensors, and controls the supply of hydraulic pressure. The ECU may include a processor, memory, and associated hardware, software, and/or firmware as may be selected and programmed by a person of ordinary skill in the art based on the teachings herein.

In the drawings and the description, the first cam lobe 110 and the second cam lobe 120 are considered to be a low lift cam lobe and a high lift cam lobe, respectively, but the opposite may be true, by a simple modification of the conjunction part 400 in a manner that will be apparent to those of ordinary skill in the art.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A variable valve lift apparatus comprising: a camshaft comprising a first cam lobe and a second cam lobe; a cam follower comprising a first follower contacting the first cam lobe and a second follower contacting the second cam lobe; a connection rotatably connecting the first follower to the second follower; a main body supporting the first follower and the second follower; a connector selectively connecting the first follower and the second follower to the main body; a lost motion elastic member provided on the main body for supplying restoring force to the first follower and the second follower; and a valve configured to be opened and closed by the cam follower; wherein the connector comprises a plurality of locker pins; a hydraulic pressure supplying apparatus that selectively supplies hydraulic pressure to the plurality of locker pins for the first follower or the second follower to be connected to the main body; wherein the plurality of locker pins comprise a first locker pin, a second locker pin, and a return pin that supplies a restoring force to the first locker pin; a supporting pin provided on the main body; a supporting pin hole in the return pin for preventing interference with the supporting pin; and a return spring disposed between the supporting pin and the return pin for supplying restoring force to the return pin.

2. The variable valve lift apparatus of claim 1, wherein the hydraulic pressure supplying apparatus comprises a first hydraulic pressure supplying apparatus that supplies hydraulic pressure to the first locker pin, and a second hydraulic pressure supplying apparatus that supplies hydraulic pressure to the second locker pin.

3. The variable valve lift apparatus of claim 2, wherein the first hydraulic pressure supplying apparatus comprises a hydraulic piston and a blocking plate.

4. The variable valve lift apparatus of claim 2, wherein the second hydraulic pressure supplying apparatus comprises a hydraulic piston and a blocking plate.

5. The variable valve lift apparatus of claim 2, wherein when the first locker pin is supplied hydraulic pressure from the first hydraulic pressure supplying apparatus, the first locker pin disconnects the first follower from the main body.

6. The variable valve lift apparatus of claim 2, wherein when the second locker pin is supplied hydraulic pressure from the second hydraulic pressure supplying apparatus, the second locker pin connects the second follower to the main body.

7. The variable valve lift apparatus of claim 1, further comprising:

a supporting pin in the second follower;

a supporting pin hole in the second locker pin for preventing interference with the supporting pin; and a return spring disposed between the supporting pin and the second locker pin for supplying restoring force to the second locker pin.

8. The variable valve lift apparatus of claim 7, further comprising a stopper disposed between the supporting pin and the second locker pin.

9. The variable valve lift apparatus of claim 1, wherein the cam follower comprises a first roller contacting the first cam lobe and a second roller contacting the second cam lobe.

10. The variable valve lift apparatus of claim 9, wherein the first follower comprises a supporting step for preventing the first follower from disconnecting from the main body.

11. The variable valve lift apparatus of claim 1, wherein the lost motion elastic member comprises a spring cap, a plunger, and a lost motion spring disposed between the spring cap and the plunger.

12. The variable valve lift apparatus of claim 1, wherein the connection comprises a connecting pin and a connecting pin insertion hole.

* * * * *